US009375825B2

(12) United States Patent
Sun et al.

(10) Patent No.: US 9,375,825 B2
(45) Date of Patent: Jun. 28, 2016

(54) POLISHING PAD CONDITIONING SYSTEM INCLUDING SUCTION

(71) Applicant: Applied Materials, Inc., Santa Clara, CA (US)

(72) Inventors: Lizhong Sun, San Jose, CA (US); Byung-Sung Leo Kwak, Portland, OR (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 14/266,543

(22) Filed: Apr. 30, 2014

(65) Prior Publication Data

US 2015/0314417 A1 Nov. 5, 2015

(51) Int. Cl.

| | |
|---|---|
| ***B24B 53/017*** | (2012.01) |
| ***B24B 55/06*** | (2006.01) |
| ***B24B 53/007*** | (2006.01) |

(52) U.S. Cl.

CPC ..... *B24B 53/017* (2013.01); *B24B 53/007* (2013.01); *B24B 55/06* (2013.01)

(58) Field of Classification Search

CPC ..... B24B 53/017; B24B 53/003; B24B 53/00
USPC ..... 451/56, 443, 444, 72, 288, 456, 41
See application file for complete search history.

(56) References Cited

U.S. PATENT DOCUMENTS

| | | | | |
|---|---|---|---|---|
| 5,885,137 | A * | 3/1999 | Ploessl | 451/56 |
| 6,036,583 | A | 3/2000 | Gantvarg et al. | |
| 6,190,236 | B1 * | 2/2001 | Drill | 451/41 |
| 6,530,827 | B2 * | 3/2003 | Mitsuhashi | 451/72 |
| 6,929,536 | B2 | 8/2005 | Kuhn et al. | |
| 7,052,371 | B2 | 5/2006 | Benner | |
| 7,544,113 | B1 * | 6/2009 | Benner | 451/5 |
| 2014/0113533 | A1 | 4/2014 | Fung et al. | |

* cited by examiner

*Primary Examiner* — Robert Rose
(74) *Attorney, Agent, or Firm* — Fish & Richardson P.C.

(57) ABSTRACT

A system for use in substrate polishing includes a conditioner system for conditioning a surface of a polishing pad and a vacuum system having a vacuum port. The conditioner system includes a conditioner head constructed to receive an abrasive conditioner component. The vacuum system is configured to apply suction through the vacuum port to the surface of the polishing pad in a direction away from the surface to remove material on the surface.

12 Claims, 2 Drawing Sheets

POLISHING PAD CONDITIONING SYSTEM INCLUDING SUCTION

TECHNICAL FIELD

The present disclosure relates to conditioning of polishing pads.

BACKGROUND

An integrated circuit is typically formed on a substrate by the sequential deposition of conductive, semiconductive, or insulative layers on a silicon wafer. A variety of fabrication processes require planarization of a layer on the substrate. For example, for certain applications, e.g., polishing of a metal layer to form vias, plugs, and lines in the trenches of a patterned layer, an overlying layer is planarized until the top surface of a patterned layer is exposed. In other applications, e.g., planarization of a dielectric layer for photolithography, an overlying layer is polished until a desired thickness remains over the underlying layer.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. Abrasive polishing slurry is typically supplied to the surface of the polishing pad.

After the CMP process is performed for a certain period of time, the surface of the polishing pad becomes glazed due to accumulation of slurry by-products and/or material removed from the substrate and/or the polishing pad. Glazing reduces pad asperity, thus reducing the polishing rate. In addition, glazing may cause the polishing pad to lose some of its capacity to hold the slurry, further reducing the polishing rate.

Typically, the properties of the glazed polishing pad can be restored by a process of conditioning with a pad conditioner. The pad conditioner is used to remove the unwanted accumulations on the polishing pad and regenerate the surface of the polishing pad to a desirable asperity. Typical pad conditioners include a conditioning disk generally embedded with diamond abrasives which can be rubbed against the pad surface of the glazed polishing pad to retexture the pad.

SUMMARY

In one aspect, a system for use in substrate polishing includes a conditioner system for conditioning a surface of a polishing pad and a vacuum system having a vacuum port. The conditioner system includes a conditioner head constructed to receive an abrasive conditioner component. The vacuum system is configured to apply suction through the vacuum port to the surface of the polishing pad in a direction away from the surface to remove material on the surface.

In another aspect, a method of treating a polishing pad includes applying an abrasive conditioner component to a surface of a polishing pad for conditioning the surface, and applying suction to the surface being conditioned along a direction away from the surface to remove material from the surface.

Implementations may optionally include one or more of the following advantages. When a polishing surface of a polishing pad is conditioned, suction is applied through a vacuum system to prevent pad glazing and to quickly and effectively, e.g., substantially completely, remove polishing detritus, which can include debris, slurry and cleaning fluid, from the polishing surface. As compared to a conditioning system without the vacuum system, the conditioning process can be performed more efficiently and the throughput of the process can be improved; and the wafer polished by the conditioned pad can have fewer defects caused by the polishing detritus remaining on the polishing surface after the conditioning. Furthermore, the use of the vacuum system can reduce the amount of cleaning fluid needed for the conditioning process, thereby reducing the cost and possible harmful effects on the environment.

The details of one or more implementations are set forth in the accompanying drawings and the description below. Other aspects, features, and advantages will be apparent from the description and drawings, and from the claims.

DETAILED DESCRIPTION

Polishing pads are used in polishing apparatuses for polishing substrates. Over time, polishing surfaces of the polishing pads are worn and need to be conditioned to restore features, such as roughness or abrasiveness, that are useful in polishing the substrates. Typically, a conditioning head that includes an abrasive conditioner component can be used for conditioning the polishing surfaces. Additional cleaning fluids may be applied to the conditioned surfaces to further condition the polishing surfaces and carry away loosened surface materials, polishing debris, and slurry. The polishing apparatus of this specification also includes a vacuum system that applies suction to the conditioned surfaces to remove materials such as polishing debris, cleaning fluids, and slurry. With the vacuum system, the conditioning process can be performed more efficiently and the throughput of the conditioning and polishing processes can be improved. The use of the vacuum system can also remove unwanted materials from the polishing surfaces so that substrates polished by the conditioned polishing pads can have fewer defects. Furthermore, the use of the vacuum system can reduce the amount of cleaning fluid needed for the conditioning processes, thereby reducing the cost and possible harmful effects on the environment.

Figure 1:
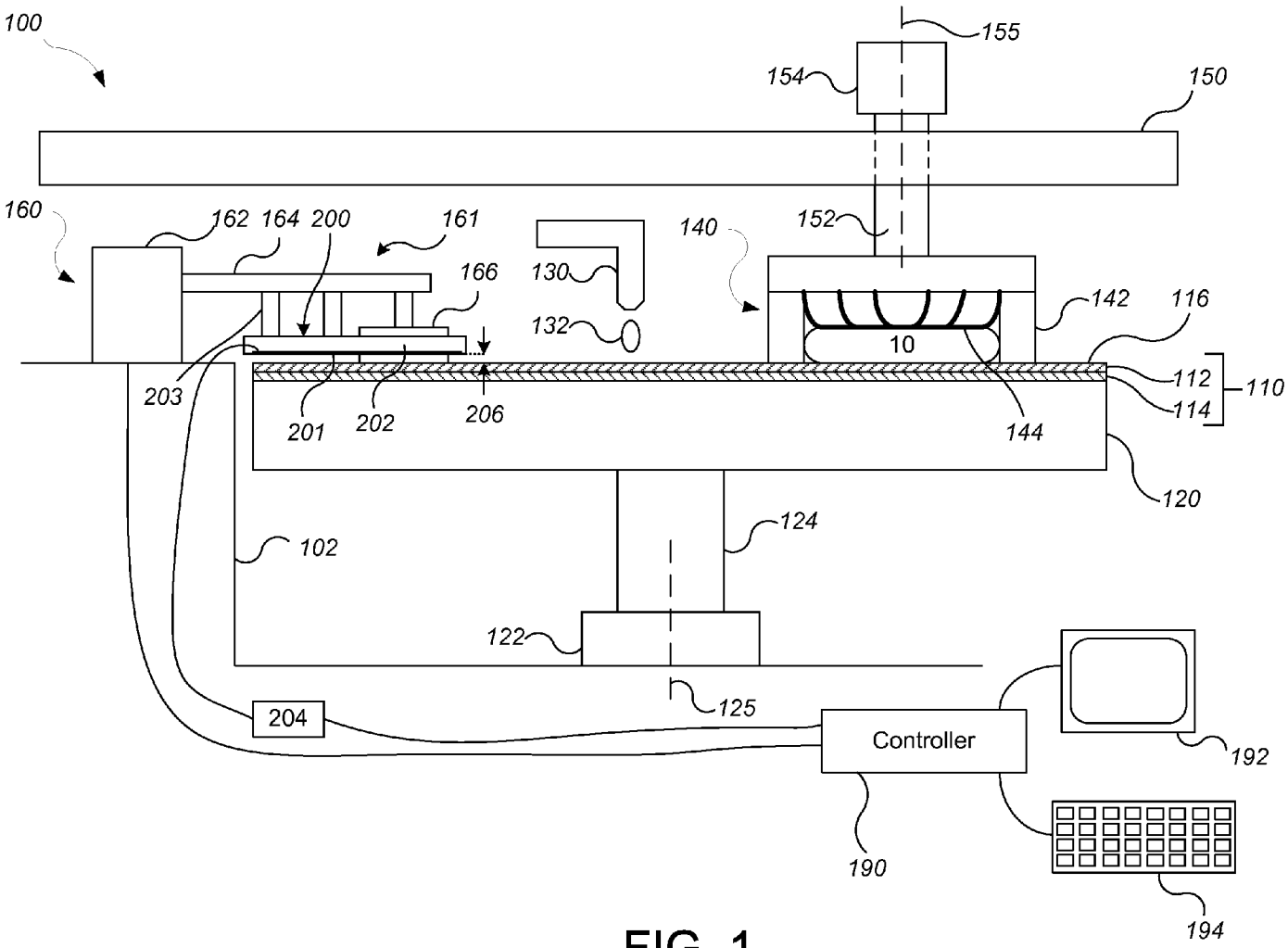
FIG. 1 illustrates a schematic cross-sectional side view of an example polishing apparatus.

FIG. 1 illustrates an example of a polishing apparatus 100. The polishing apparatus 100 includes a rotatable disk-shaped platen 120 on which a polishing pad 110 is situated. The platen 120 is operable to rotate about an axis 125. For example, a motor 122 can turn a drive shaft 124 to rotate the platen 120. The platen 120 can rotate at about 30-200 rpm.

The polishing pad 110 can has a polishing surface 116. The polishing pad 110 can be a two-layer polishing pad with an outer polishing layer 112 and a softer backing layer 114. The layer that provides the polishing surface 116, e.g., the outer polishing layer 112, can be a porous polyurethane, e.g., an IC-1000 material.

The polishing apparatus 100 can include a port 130 to dispense polishing liquid 132, such as slurry, onto the polishing pad 110. The slurry 132 can include silica abrasive particles, e.g., the slurry can be SS-12.

The polishing apparatus 100 includes at least one carrier head 140. While only one carrier head 140 is shown, more carrier heads can be provided to hold additional substrates so that the surface area of polishing pad 110 may be used efficiently.

The carrier head 140 is operable to hold a substrate 10 against the polishing pad 110. The carrier head 140 can have independent control of the polishing parameters, for example pressure, associated with each respective substrate. The carrier head 140 can include a retaining ring 142 to retain the substrate 10 below a flexible membrane 144. Pressurization of one or more chambers behind the membrane 144 controls the pressure applied to the substrate 10. Although only three chambers are illustrated in FIG. 1 for ease of illustration, there could be one or two chambers, or four or more chambers, e.g., five chambers.

The carrier head 140 is suspended from a support structure 150, e.g., a carousel or a track, and is connected by a drive shaft 152 to a carrier head rotation motor 154 so that the carrier head can rotate about an axis 155. The carrier head 140 can rotate at about 30-200 rpm. Optionally the carrier head 140 can oscillate laterally, e.g., on sliders on the carousel 150 or track; or by rotational oscillation of the carousel itself. In operation, the platen is rotated about its central axis 125, and the carrier head is rotated about its central axis 155 and translated laterally across the top surface of the polishing pad.

The polishing apparatus can also include a polishing pad conditioning system 160 to abrade the polishing pad 110 to maintain the polishing pad 110 in a consistent abrasive state. The polishing pad conditioning system 160 includes a conditioner 161 having a base 162, an arm 164 that can sweep laterally over the polishing pad 110, and a conditioner head 166 connected to the base 162 by the arm 164. The base 162 is mounted on a frame 102 of the polishing apparatus 100 that can also support the other components, e.g., the platen 120 and the support structure 150. As an example, the base 162 includes a rotary actuator held on a support that is secured to the frame. The arm 164 is affixed to the rotary actuator, and rotation of the actuator causes the lateral sweep of the arm 162 across the polishing pad. The conditioner head 166 includes an abrasive surface configured to condition the surface 116 of the polishing pad 110. The abrasive surface can be rotatable, and the pressure of the abrasive surface against the polishing pad can be controllable.

Figure 2:
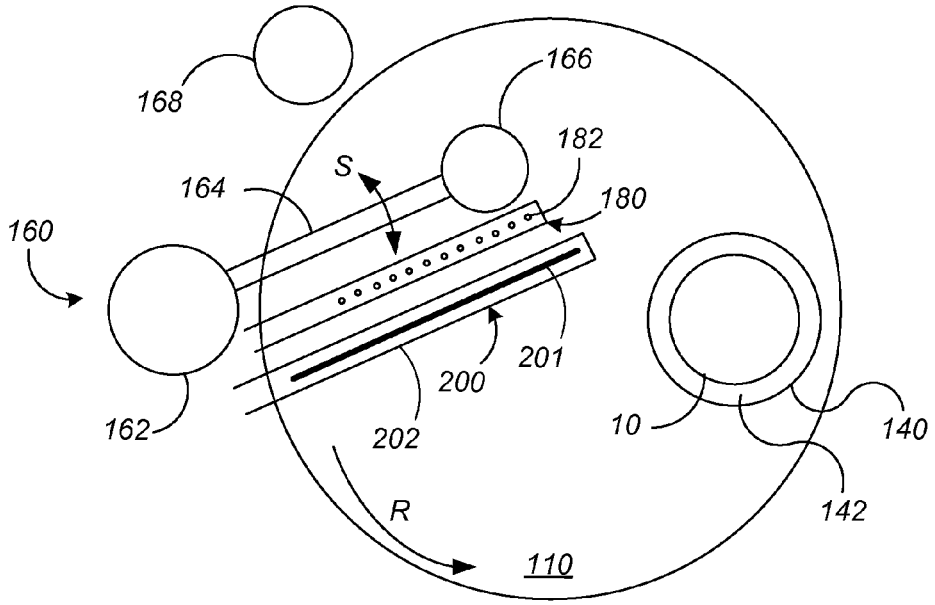
FIG. 2 is a schematic top view of an example polishing station of a polishing apparatus.

Referring to FIG. 2, optionally, the polishing apparatus 100 can include a rinsing cup 168 supported on the frame 102 and positioned in a location such that the arm 164 can position the conditioner head 166 in the cup 168. The rinsing cup 168 can contain a fluid for rinsing the conditioner head 166, or a set of nozzles can be mounted in the cup to spray cleaning fluid on the conditioner head 166. Before and after the conditioning operation, the conditioner head 166 can be positioned in the rinsing cup 168 for cleaning.

In one mode of operation, the polishing pad 110 is conditioned by the conditioner head 166 while the polishing pad 110 polishes a substrate 10 which is mounted on carrier head 140. In some implementations, the arm 164 is pivotally attached to the base 162, and sweeps back and forth to move the conditioner head 166 in an oscillatory sweeping motion (shown by arrows S) across polishing pad 110. The motion of the conditioner head 166 can be synchronized with the motion of carrier head 140 to prevent collision.

In another mode of operation, the polishing pad 110 is conditioned by the conditioner head 166 ex-situ, i.e., when the polishing pad 110 is not polishing any substrate. For example, the conditioning can be performed between polishing of wafers (i.e., after one wafer is polished and before the next wafer starts to be polished).

In some implementations, in an ex-situ conditioning process, a cleaning fluid is delivered at a relatively high pressure to the surface 116 of the polishing pad 110. For example, the delivery pressure is about 30 psi or higher. The cleaning fluid reaches the surface 116 at a high speed to carry polishing detritus, which can include debris and slurry, away from the surface. The cleaning fluid can be delivered to the surface 116 through channels and openings in the conditioner head 166, e.g., after the conditioner head 166 abrades the polishing pad 110. The cleaning fluid can also be delivered through other channels and openings, such as nozzles, that are independent of the conditioner head 166. For example, an arm 180 can extend over the polishing pad, and the nozzles 182 to dispense the cleaning fluid can be located on the bottom of the arm 180. In some implementations, the arm 180 serves as a combined slurry dispense/cleaning arm that supports both the nozzles 182 and the port 130.

In some implementations, in an ex-situ conditioning process, the conditioner head 166 does not include any abrasive surfaces for conditioning the surface 116. Instead, the conditioner head 166 includes channels and openings, e.g., nozzles, that deliver a cleaning fluid from a reservoir that stores the cleaning fluid to the surface 116. The cleaning fluid is applied to the surface 116 at a high speed to detach polishing debris from the surface and carry the debris away from the surface.

The cleaning fluid may include deionized water, e.g., the deionized water only. Sometimes a large amount of the cleaning fluid is needed. For example, to perform ex-situ conditioning on the polishing pad, the consumption rate of the deionized water is about 2 L per wafer or about 1.5 ton per day per polishing pad.

A controller 190, e.g., can be connected to the conditioning system 160 to control various parameters associated with the conditioning process, e.g., the lateral sweep of the arm 164, and/or delivery pressure or speed of the cleaning fluid. The controller 190 may include a display 192 and an input device 194, through which a user may interact with the controller to obtain information related to the polishing and the conditioning processes, and/or to control the polishing and/or the conditioning processes.

Referring again to FIG. 1, in addition to the conditioner 161, the conditioning system 160 also includes a vacuum system 200 that couples to the conditioner head 166. The vacuum system 200 includes a vacuum port 201, e.g., a continuous slit or a plurality of holes, formed in the side of a housing 202 adjacent the platen 120. The vacuum port 201 is connected to a vacuum pump 204. The vacuum pump 204 is controlled by a controller, such as the controller 190.

In operation, the vacuum port 201 can be placed above a selected location on a polishing pad or in direct contact with the polishing pad at the location. The vacuum pump 204 is run such that the vacuum system 200 applies suction with a pressure P in a direction away from the surface 116. In other words, the pressure in a space 206 between the vacuum port 201 and the surface 116 is lower than the atmospheric pressure in which the polishing system 100 is situated. As a result, materials, such as polishing detritus including debris, slurry, and cleaning fluid, on the surface 116 and in the space 206 are sucked into the vacuum system 200.

In a conditioning process, at least part of the vacuum system 200 can move with the conditioner head 166. As the conditioner head 166 applies the cleaning fluid to the surface 116 to condition the pad 110, the vacuum system 200 is operated to suck the fluid cleaner and the debris away from the surface 116. In some implementations, the vacuum system 200 is stationary.

In the example shown in FIG. 1, an arm 203 connects the housing 202 with the vacuum port 201 to the arm 164 of the conditioner system 160 such that the movement of the vacuum port 201 is coordinated or synchronized with the movement of the conditioner head 166. Other types of vacuum system or coupling mechanisms may also be implemented. For example, the vacuum port 201 can be moved by an arm independent of the arm 164. Alternatively or in addition, vacuum could be applied to the polishing pad through a port in the conditioner head 166. The port could be in the center of the conditioner arm.

The magnitude of the pressure P can be chosen based on the physical configuration of the vacuum system and the parameters of the conditioning or polishing process, e.g., the distance between the vacuum port 201 and the polishing pad 110, the platen rotation rate. The pressure value may be predetermined for a conditioning process, or can be adjusted during the process, e.g., based on detection of an amount of debris to be removed or an amount of cleaning fluid used.

The vacuum port 201 can be arranged to surround, e.g., less than all of, the peripherals of the conditioner head 166. In some implementations, the vacuum port 201 extends such that all points that pass under the conditioner head 166 also pass below the vacuum port 201.

Figure 3:
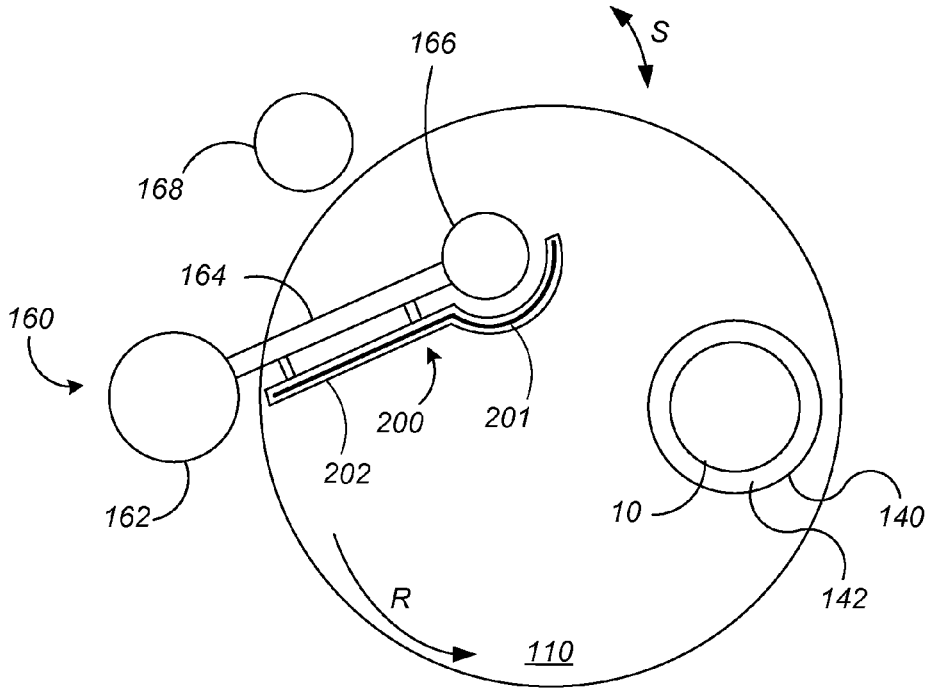
FIG. 3 is a schematic top view of another example polishing station of a polishing apparatus.

In some examples, the vacuum system 200 is arranged such that for a given spot on the polishing surface 116, the cleaning fluid is applied through nozzles (not shown) of the conditioner head 166 to the spot before the platen rotates the spot to be under the vacuum port 201 where a suction force is applied to the spot (see, e.g., FIG. 3).

In some implementations, the polishing system is configured such that when the platen is rotating, a particular spot will be conditioned, then contacted by the cleaning fluid, then subject to the vacuum of the vacuum system, and then pass below the carrier head. For example, along the rotation direction R of the platen, a given spot on the polishing surface 116 passes under the conditioner head 166 first, the fluid dispenser 180 second, and the vacuum port 201 third, and under the carrier head 140 last (see, e.g., FIG. 2).

In some implementations, the polishing system is configured such that when the platen is rotating, a particular spot will be contacted by the cleaning fluid, then conditioned, then subject to the vacuum of the vacuum system, and then pass below the carrier head.

In some implementations, the position of the carrier head relative to the conditioning head 166, dispenser 180, and vacuum port 201 can be modified. For example, along the direction of rotation, the carrier head could be between the dispenser and the vacuum port. However, if the polishing pad is conditioned while polishing is being performed, it is desirable to have the vacuum port 201 between the carrier head 140 and the conditioner head 166, so that pad debris is suctioned away before it reaches the substrate 10.

In situations where the cleaning fluid is dispensed by nozzles on the conditioning arm itself, then conditioning and dispensing can occur effectively simultaneously, or the nozzles can be angled such that the cleaning fluid is dispensed to a position on the polishing pad before or after (along the direction of rotation) the region being conditioned, but before the vacuum.

The conditioning head 166, the dispenser 180, and the housing 202 are arranged such that when stationary or moving, these elements do not collide with or interfere with the functions of the carrier head 140.

For the purpose of the discussion, the vacuum port 201 is arranged "downstream" of the conditioner head 166 and the dispenser 180, i.e., further along in the direction of rotation of the platen 110. The downstream arrangement of the vacuum port 201 can facilitate debris removal from the surface 116. The cleaning fluid applied before the vacuum system 200 can expose or detach the debris from a conditioned spot on the surface 116. The vacuum system 200 then can efficiently and effectively, e.g., substantially completely, remove all debris from the spot. For example, compared to a conditioning system used in a system comparable to the system 100 without the vacuum system 200, the conditioning system 160 can reduce polishing defects on a substrate caused by debris on the polishing surface 116.

In some implementations, when the vacuum system 200 is used in an ex-situ conditioning process, the delivery speed and/or the amount of cleaning fluid for use in the conditioning can be reduced. For example, the debris can be carried away from the surface 116 by both the vacuum system 200 and the flow of the cleaning fluid, such that it is not necessary to flow the cleaning fluid at a speed as high as in a conditioning system without the vacuum system. The reduced flow speed can reduce the amount of cleaning fluid needed for the conditioning process. In the example of deionized water, the consumption during the ex-situ conditioning can be reduced to about 0.5 L per wafer or less, or about 0.4 ton per day per polishing pad or less, e.g., 0.38 ton per day per polishing pad or less. Compared to a conditioning process without applying the vacuum system 200, the saving of the cleaning fluid can be up to 75% or more. The reduced amount of deionized water for use in the conditioning process can reduce the amount of CoO generated and the conditioning process can be performed more environmentally friendly.

Using the vacuum system 200 in the conditioning process may also allow the conditioning to be performed more efficiently, more effectively, and more completely than using a system without the vacuum system 200. For example, the debris can be removed more quickly and a less amount would remain at the polishing surface 116 after the conditioning process. As a result, the throughput and productivity of the conditioning process is improved. The surface 116 of the polishing pad 110 can be cleaner, so that fewer defects, such as scratches, divots, will be formed on the wafer surface polished by the surface 116. Devices containing the wafers can have a high device performance and yield.

Examples of the detailed arrangements of the vacuum port 201 relative to the conditioner head 166 are shown in FIGS. 2 and 3. The vacuum port 201 can have a shape that partially follows the shape of the conditioner head 166. In the example shown in FIG. 3, the conditioner head 166 has a round shape (in top view), and the vacuum port 201 has a curved shape (in top view) that follows the contour of the conditioner head 166. The vacuum port 201 can extend along all or substantially all of the downstream edge of the conditioner head 166. The size and shape of the vacuum port can be chosen based on various considerations, such as conditioning efficiency. For example, the vacuum port 201 can extend along 20%-80%, e.g., 40%-60%, of the periphery of the conditioner head. Although not shown, the vacuum port 201 can also have other shapes and/or locations relative to the conditioner head 166.

In some implementations, the housing 202 and the port 201 are fixed relative to the conditioner head 166. In other implementations, the relative location of the housing 202 and the port 201 can be adjusted during the conditioning of one wafer or between conditioning different wafers. In some implementations, more than one vacuum system 200 or vacuum port 201 can be used.

A description of a conditioner head for use in a conditioning system, such as conditioner head 166 of the system 160, can be found in U.S. Pat. No. 6,036,583, the entire content of which is incorporated herein by reference. The conditioning system can also include other structures, such as a damper system as described in U.S. Patent Publication No. 2014/0113533, the entire content of which is also incorporated herein by reference.

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a shape other than circular. The polishing layer can be a standard (for example, polyurethane with or without fillers) polishing material, a soft material, or a fixed-abrasive material. The arm could undergo a linearly extension motion rather than an angular sweep.

The conditioning system described above can also be used in a polishing system in which the slurry is loaded from a different source than the port 130 above the polishing pad 110 of FIG. 1. In some implementations, the slurry can be provided through the pad 110 from a source located under the pad 110.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

Embodiments of the invention and all of the functional operations described in this specification can be implemented in digital electronic circuitry, or in computer software, firmware, or hardware, including the structural means disclosed in this specification and structural equivalents thereof, or in combinations of them. Embodiments of the invention can be implemented as one or more computer program products, i.e., one or more computer programs tangibly embodied in a non-transitory machine readable storage media, for execution by, or to control the operation of, data processing apparatus, e.g., a programmable processor, a computer, or multiple processors or computers.

Particular embodiments of the invention have been described. Other embodiments are within the scope of the following claims.

What is claimed is:

1. An apparatus for use in substrate polishing, comprising:

a conditioner system for conditioning a surface of a polishing pad, the conditioner system including a conditioner head constructed to receive an abrasive conditioner component, a substantially straight arm that supports the conditioner head, and a base that supports the arm, the conditioner head including a curved contour extending beyond the arm; and a vacuum system having a vacuum port, the vacuum system being configured to apply suction through the vacuum port to the surface of the polishing pad in a direction away from the surface to remove material on the surface, wherein the vacuum port includes a first substantially straight section spaced apart from and extending parallel to the arm and a second curved section spaced apart from and extending along the curved contour of the conditioner head.

2. The apparatus of claim 1, comprising a dispenser to supply a cleaning fluid to the polishing pad.

3. The apparatus of claim 2, wherein the dispenser is configured to supply the cleaning fluid through the conditioner head.

4. The apparatus of claim 1, wherein the vacuum port surrounds less than an entirety of the curved contour of the conditioner head.

5. An apparatus for use in substrate polishing, comprising:

a conditioner system for conditioning a surface of a polishing pad, the conditioner system including a conditioner head constructed to receive an abrasive conditioner component, an arm that supports the conditioner head, and a base that supports the arm, the base including an actuator connected to the arm to sweep the arm and the conditioner head over the polishing pad; and a vacuum system having a housing horizontally spaced from the arm and a vacuum port in the housing, the vacuum system being configured to apply suction through the vacuum port to the surface of the polishing pad in a direction away from the surface to remove material on the surface, wherein the vacuum port includes a substantially straight section horizontally spaced away from and extending parallel to the arm, and wherein the housing including the substantially straight section of the vacuum port is constructed to move synchronously with the conditioner head.

6. The apparatus of claim 5, wherein the housing with the vacuum port is connected to and supported by the arm.

7. The apparatus of claim 5, wherein the vacuum port has a shape that follows a shape of part of a contour of the conditioner head.

8. The apparatus of claim 1, wherein the vacuum port is located downstream of the conditioner head, such that a given spot on the surface of the polishing pad is moved to be under the conditioner head for conditioning before to be under the vacuum port.

9. The apparatus of claim 1, further comprising a rotatable platen to support the polishing pad and a carrier head to hold the substrate in contact with the polishing pad, and wherein along a direction of rotation of the platen, the carrier head is positioned between the vacuum port and the conditioner head.

10. A method of treating a polishing pad, comprising:

applying an abrasive conditioner component to a surface of the polishing pad for conditioning the surface;

sweeping the abrasive conditioner component horizontally across the surface with an arm;

applying suction to the surface being conditioned in an area including a substantially straight section horizontally spaced away from and extending parallel to the arm of the abrasive conditioner, the suction applied along a direction away from the surface to remove material on the surface; and moving the area in which the suction is applied to the surface synchronously with the abrasive conditioner component.

11. The method of claim 10, wherein applying the abrasive conditioner component comprises moving a conditioner head relative to the surface of the polishing pad, and applying the suction comprises moving a vacuum port with the conditioner head.

12. The method of claim 11, wherein the vacuum port is downstream of the conditioner head, such that a given spot on the surface of the polishing pad is moved to be under the conditioner head for conditioning before to be under the vacuum port.

* * * * *